US005930840A

United States Patent [19]

Arai

[11] Patent Number: 5,930,840

[45] Date of Patent: Aug. 3, 1999

[54] PAD FOR INTERIOR BODY OF HELMET AND INTERIOR BODY THEREOF

[76] Inventor: Michio Arai, c/o Arai Helmet, Ltd., 12, Azuma-cho 2-chome, Ohmiya-shi, Saitama-ken, Japan

[21] Appl. No.: 08/807,876

[22] Filed: Feb. 26, 1997

[30] Foreign Application Priority Data

Mar. 1, 1996 [JP] Japan ..... 8-044697

[51] Int. Cl.[6] ..... A42B 1/06

[52] U.S. Cl. ..... 2/411; 2/425

[58] Field of Search ..... 2/410–412, 414, 2/425, 455, 456, 459–467, 468, 16, 20, 22–24, 44, 45, 267, 268

[56] References Cited

U.S. PATENT DOCUMENTS

| | | |
|---|---|---|
| 2,709,810 | 6/1955 | Dye . |
| 3,366,971 | 2/1968 | Scherz . |
| 3,471,865 | 10/1969 | Molitoris . |
| 3,843,970 | 10/1974 | Marietta et al. . |
| 4,023,231 | 5/1977 | Rovani . |
| 5,337,420 | 8/1994 | Haysom et al. . |

FOREIGN PATENT DOCUMENTS

| | | |
|---|---|---|
| 0473857 | 3/1992 | European Pat. Off. . |
| 62-70130 | 5/1987 | Japan . |
| 630810 | 8/1994 | Japan . |
| 1528647 | 10/1978 | United Kingdom . |

*Primary Examiner*—Gloria M. Hale
*Attorney, Agent, or Firm*—Watson Cole Grindle Watson, P.L.L.C.

[57] ABSTRACT

A pad for an interior body of a helmet includes a shaped cushion material made of foamed urethane or the like, a stretchable first cloth on one side of the cushion material for contact with a head of a user, a nonstretchable second cloth disposed on a side of the cushion material opposed to the cloth. The interior body includes a plurality of pads connected to form a band shape around the head of a user and so as not to bend in a vertical direction.

6 Claims, 4 Drawing Sheets

PAD FOR INTERIOR BODY OF HELMET AND INTERIOR BODY THEREOF

BACKGROUND OF THE INVENTION

Technical Field of the Invention

The present invention relates to a pad for constituting an interior body mounted onto an inner side of an impact absorbing liner in a helmet and an interior body, particularly to an improvement of an interior body mounted attachably and detachably onto an inner side of an impact absorbing liner.

Description of the Earlier Technology

A safety helmet for riding a vehicle is constituted by fitting an impact absorbing liner comprising styrene foam or the like to an inner side of an outer shell and fixedly adhering an interior body (cushion pad) formed by covering a surface of a cushion material made of foamed urethane or the like by a cloth agreeable to the skin at a predetermined portion on an inner side of the impact absorbing liner.

Meanwhile, according to the safety helmet of this kind the interior body is liable to stain by sweat, dust or the like due to its environment of use. Therefore, in recent times there have been developed various kinds of interior bodies which are attachable and detachable in respect of the impact absorbing liner in order to keep clean the interior bodies by washing them and to be able to adjust the interior bodies to snugly fit to the sides!of the human head of the user.

The interior body of a type that is attachable and detachable in respect of the impact absorbing liner, is constituted by forming a core material of a rigid synthetic resin thin plate in a ring-like shape and by stitching an interior member (pad) where a face of a cushion material in touch with the human head is covered by a cloth in direct contact with a human head, to the core material. Further, as a method of fitting the interior body attachably and detachably to and from the inner side of an impact absorbing liner, there has been adopted a method where snap fasteners are attached to the inner side face of the impact absorbing liner whereas mating snap fasteners engaging and disengaging with the snap fasteners are attached to the other side of the interior body (Japanese Utility Model Publication No. Hei 6-30810) or the like.

Accordingly, when such a helmet mounted with the interior body is worn, a touch feeling in respect of the skin gives a hard feeling since the rigid core material is arranged at the back side of the interior body and further, if the outer shape of the interior body is larger than the outer shape of the core material, stepped differences are caused in the compressed interior body, which gives a uncomfortable feeling.

Further, there has been proposed a method where notches are provided at portions of the lower side edge of the outer periphery of an impact absorbing liner as an attaching structure of an interior body and the interior body is fixed by inserting projection pieces connected with the interior body between an outer shell and the impact absorbing liner by utilizing the notches (Japanese Utility Model Laid-Open No. Sho 62-70130).

According to the attaching structure of the above-described interior body, although the problems of the touch feeling and the uncomfortable feeling in wearing the helmet may be resolved, attachment and detachment of the interior body is troublesome and further, the safety is deteriorated since portions of the impact absorbing liner that is mounted onto a helmet with a purpose of alleviating and absorbing impact are notched.

Furthermore, as the method of fitting the attachable and detachable interior body, a method of fixing the interior body to the inner side face of the impact absorbing liner by using a velvet type fastener without using the core material, is conceivable. However, in this case the interior body is liable to shift, which is problematic in the feeling of use and further, which is devoid of durability. Further, although the rigidity in the plane direction may be provided by increasing the thickness of the interior body, the thickness of the interior body is self-evidently limited in consideration of the feeling of use when the helmet is worn and therefore, in reality a thick interior body cannot be adopted.

SUMMARY OF THE INVENTION

The present invention has been carried out in view of the above-described problems of the conventional technology and it is an object of the present invention to provide a pad for an interior body having a rigidity in the plane direction (X-axis, Y-axis directions) while restraining the thickness to a minimum and an interior body capable of ensuring the touch feeling dispensing with the strange feeling and the safety.

In order to achieve the above-described object, according to the technical means of a pad for an interior body that is devised by the present invention, a stretchable cloth in direct contact with a human head is pasted on one side face of a cushion material made of foamed urethane or the like, a cloth disposed on a side opposed to the cloth in direct contact with a human head comprising a nonstretchable cloth or a film is pasted on the other side face thereof and an assemblage thereof is cut into a predetermined shape. Incidentally, the peripheries of the cloth in direct contact with a human head and the cloth disposed on a side opposed to the cloth in direct contact with a human head are aligned and stitched together when the appearance of the outlook (attractiveness) is considered, although this operation has nothing to do with the function of the pad per se.

As the cloth in direct contact with a human head pasted on the one side face of the cushion material, a cloth which is stretchable and has an excellent skin touch feeling, for example, french pile made of nylon is pointed out.

Also, as the cloth disposed on a side opposed to the cloth in direct contact with a human head pasted on the other side face of the cushion material, a nonstretchable plain weave fabric made of nylon which is pasted and cut such that yarn directions thereof are biased in respect of X-axis (horizontal axis=peripheral direction) and Y-axis (vertical axis) in the plane of the pad, or a film made of resin where perforations are opened or the like is pointed out.

As the predetermined shape of the pad formed by the above-described constitution, a modified trapezoidal shape (broad bean shape) as shown by FIG. 1, a rectangular shape, a square shape or the like is pointed out.

Further, the pads for the interior body constituted as described above are arranged in the peripheral direction at predetermined intervals and end portions in the peripheral direction of the pads are connected to the both end portions in the longitudinal direction of rigid core materials in a band-like shape, which are put side by side in parallel to each other from a forward position toward a rearward position thereby constituting the interior body.

The shape of the interior body may be a ring-like shape, or a pertinent shape such as a shape where the interior body is separated into a forward portion and a rearward portion or the like.

By the above-described constitution, a pad which is nonstretchable at least in respect of the plane direction (X, Y directions), which is provided with rigidity and which is abound with shape maintaining performance, is finished as the pad for the interior body. Further, the interior body capable of fixing to a predetermined position on the inner side of the impact absorbing liner is completed by connecting distal ends in the peripheral direction of the pads via the core materials.

Furthermore, the core materials for connecting the pads are present partially in the peripheral direction and therefore, portions where the core materials are disposed are formed in a shape of a groove that is put between the pads. Therefore, the portions where the core materials are attached effectively function as vent grooves.

DESCRIPTION OF THE PREFERRED EMBODIMENT(S)

An explanation will be given of embodiments of the present invention in reference to the drawings as follows.

Figure 1:
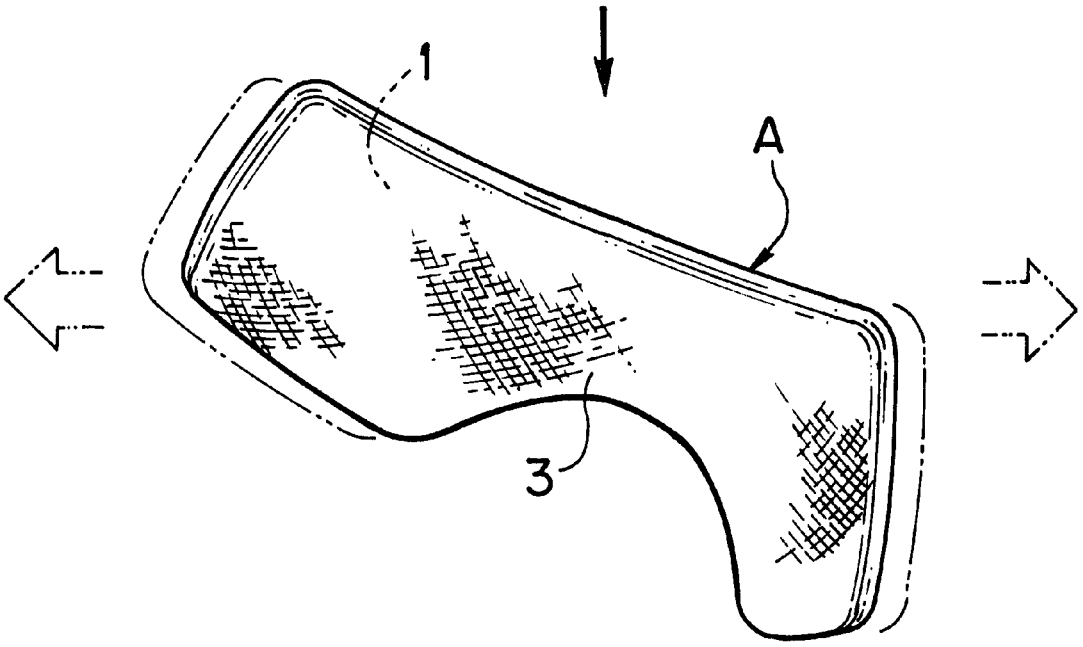
FIG. 1 is a perspective view showing a pad according to the present invention.
Figure 2:
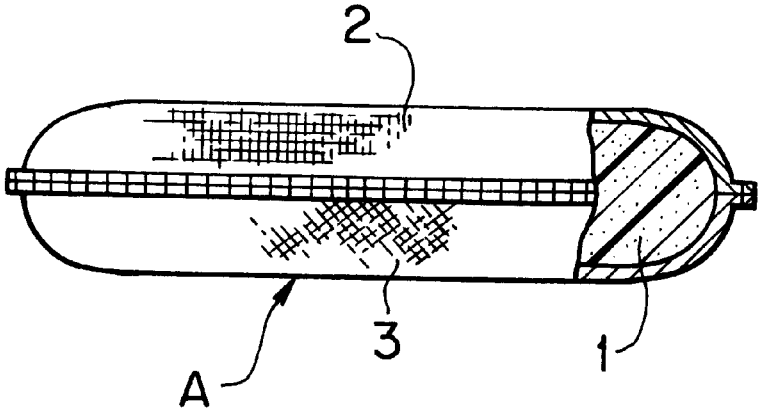
FIG. 2 is a partially broken plane view of the pad.

FIG. 1 and FIG. 2 illustrate a pad for constituting an interior body. The pad A is formed in a predetermined shape by pasting a cloth 2 in direct contact with a human head made of pile cloth or the like which is agreeable to skin touch and is stretchable onto a side face of a cushion material 1 made of foamed urethane or the like, pasting a nonstretchable cloth 3 disposed on a side opposed to the cloth in direct contact with a human head on the other side face thereof and stitching together the peripheries of the cloth 2 in direct contact with a human head and the cloth 3 disposed on a side opposed to the cloth 2.

Figure 3:
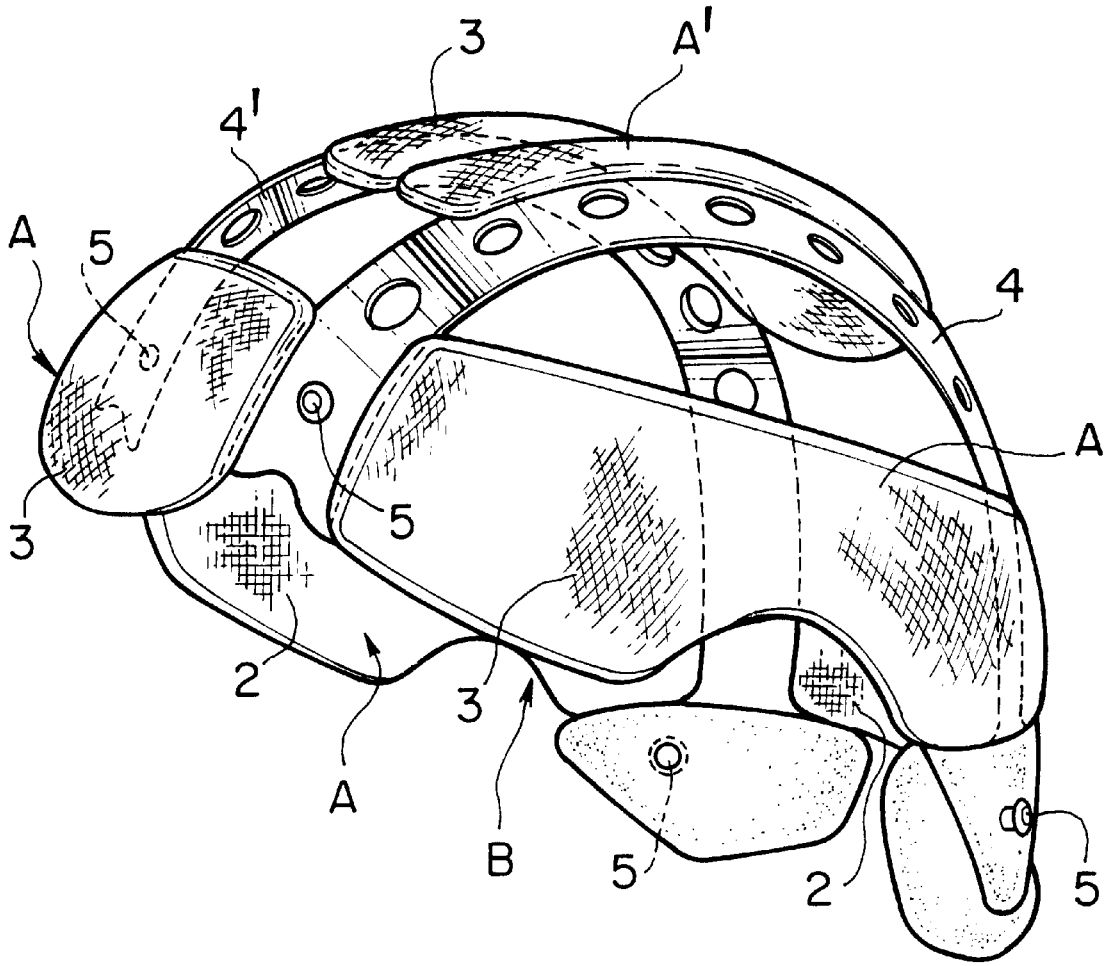
FIG. 3 is a perspective view showing an interior body constituted by connecting the pads.

In respect of the shape of the pad, the pad is formed in a modified trapezoidal shape as illustrated by FIG. 1, or a substantially square shape similar to those of pads arranged at the forward and rearward portions of an interior body illustrated by FIG. 3.

The cloth 3 mentioned above is pasted on the cushion material 1 such that a plain weave fabric made of nylon is biased in respect of X-axis direction (horizontal direction) and Y-axis direction (vertical direction) of the cushion material 1 whereby the interior body is not bent in Y-axis direction although a more or less stretchability is secured in respect of the horizontal direction (peripheral direction). Thereby, the pad A is provided with a rigidity in X-axis direction (horizontal direction) and Y-axis direction (vertical direction).

FIG. 3 illustrates an interior body B constituted by using the pads A. The interior body B is formed in a ring-like shape by connecting the distal ends in the horizontal direction of the pads A via core materials 4 and 4' each formed by a rigid band plate made of a synthetic resin.

That is, the core materials 4 and 4' formed in a circular arc shape are arranged in alignment with the helmet from a forward position toward a rearward position thereof such that the circular arc shapes respectively face outwardly, the pads A are arranged between the ends of the circular arcs of the core materials 4 and 4', the distal ends are stitched thereto, the pads A are also arranged between both of the core material 4 and the core material 4' and the distal ends are stitched thereto whereby the interior body B in a ring-like shape is constituted.

Accordingly, no core materials are present between the impact absorbing liner C and the human head at the rear side portions of the pads A as in the conventional helmet and therefore, the touch feeling of the pads which are brought into contact with the human head is given by the cushion material per se whereby the helmet can be worn with a soft feeling.

Incidentally, also a pad (crown pad) A' that is brought into contact with the top of the human head is stitched to the core material 4 and the core material 4' to span the core material 4 and the core material 41.

Further, snap fasteners 5 for fixing the interior body B to the inner side of the impact absorbing liner C are fixed to the core materials 4 and 4' constituting the above-described interior body B. The interior body B can be fixed attachably and detachably to and from the impact absorbing liner C by fittedly engaging the snap fasteners 5 with mating snap fastener members 6 provided on the inner face of the impact absorbing liner C.

Incidentally, the core materials 4 and 4' are provided for connecting the pads A and forming them in a ring-like shape to the utmost of their purpose and therefore, the magnitude (size) of the core materials 4 and 4' are made as small as possible.

Figure 4:
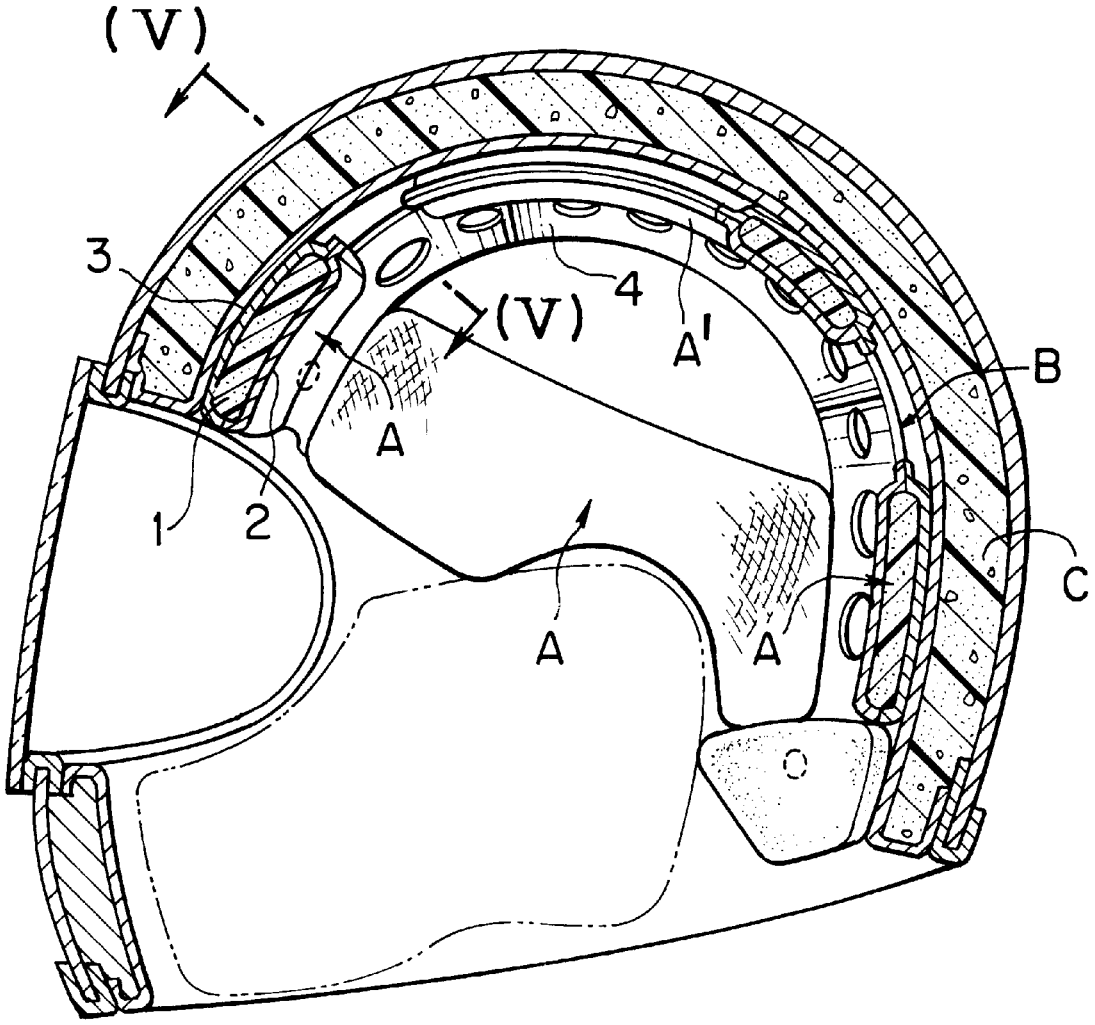
FIG. 4 is a longitudinal sectional view showing a state where the interior body is attached to a helmet.
Figure 5:
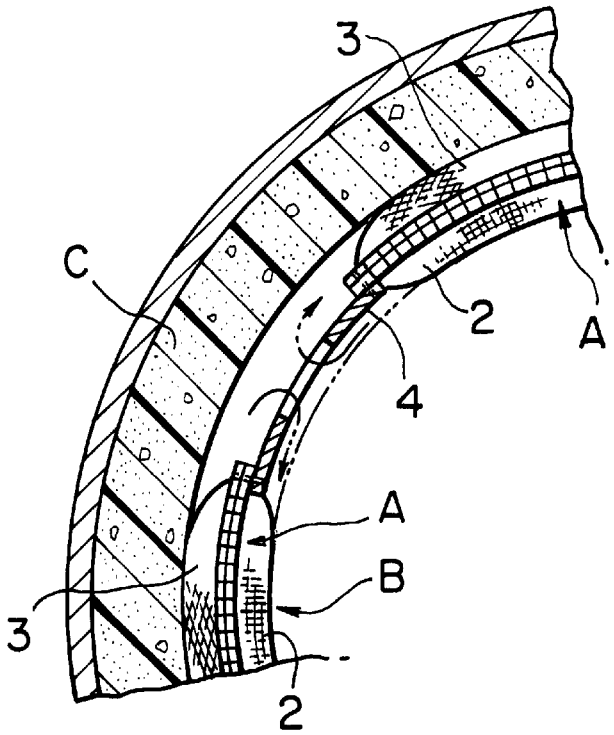
FIG. 5 is an enlarged sectional view taken along a line 5–5 of FIG. 4.
Figure 6:
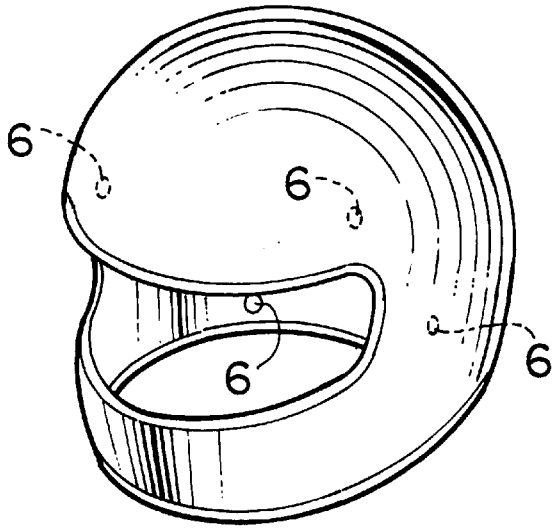
FIG. 6 is a perspective view showing a helmet having mating snap fasteners for fixing an interior body.

The interior body B constituted as described above can be fixed to the inner side of the impact absorbing liner C of the helmet with certainty by the mating snap fastener members 6 and the snap fasteners 5 shown by FIG. 4. Further, in the attached state the bending deformation of the pads A in X-axis direction and Y-axis direction is restrained by the cloth 3 disposed on a side opposed to the cloth in direct contact with a human head and accordingly, the interior body B where the pads A are connected by the core materials 4 and 4', secures the predetermined shape. Also, the portions of the core materials 4 and 4' for connecting the pads A create a groove-like shape and therefore, air vent operation is effectively conducted whereby the less muggy interior body can be provided.

According to the pad for an interior body of the present invention, the rigidity in respect of the plane direction (X-axis, Y-axis directions) may be provided while restraining the thickness in the thickness direction to a minimum and accordingly, the pad for an interior body excellent in shape maintaining performance can be provided.

Further, no core materials are present on the rear side of the pad as in the conventional helmet and therefore, there is no strange feeling that is caused when the core materials are brought into indirect contact with the human head, owing to the cushion material as the constituent member of the pads, in compressing the pads whereby the interior body fitted softly to the human head and having a soft touch can be provided. Furthermore, the core materials constitute grooves between the pads and therefore, the portions of the core materials function as vent grooves whereby the interior body excellent in vent function can be provided.

Having described specific preferred embodiments of the invention with reference to the accompanying drawing, it will be appreciated that the present invention is not limited to those precise embodiments, and that various changes and modification can be effected therein by one of ordinary skill in the art without departing from the scope or spirit of the invention as defined by the appended claims.

What is claimed is:

1. A pad for an interior body of a helmet comprising:

a shaped cushion material having a first side facing a head of a user and an opposite second side;

a stretchable cloth covering said first side of said cushion material for direct contact with a head of a user; and a nonstretchable cloth disposed on said second side of said cushion material, said nonstretchable cloth being a plain weave fabric pasted and cut such that yarn directions thereof are biased in respect of a longitudinal direction of the pad.

2. The pad for according to claim 1, wherein said nonstretchable cloth is a nonstretchable film.

3. The pad according to claim 1, wherein said cushion material has a generally trapezoidal configuration.

4. An interior body of a helmet comprising:

a plurality of shaped cushion materials each having a first side facing a head of a user and an opposite second side;

a stretchable cloth covering said first side of each said cushion material for direct contact with a head of a user; and a nonstretchable cloth disposed on said second side of each said cushion material, said nonstretchable cloth being a plain weave fabric pasted and cut such that yarn directions thereof are biased in respect of a longitudinal direction of the pad, and a plurality of rigid core materials connecting end portions of said pads to form a substantially ring shape whereby said pads do not bend in vertical direction.

5. The interior body of a helmet according to claim 4, wherein the nonstretchable cloth of each pad is a nonstretchable film.

6. The interior body of a helmet according to claim 5, wherein one of said plurality of pads has a generally trapezoidal shape.

* * * * *